US006796215B1

(12) United States Patent
Hauser et al.

(10) Patent No.: US 6,796,215 B1
(45) Date of Patent: Sep. 28, 2004

(54) MEMBRANE PUMP

(75) Inventors: Erwin Hauser, Emmendingen-Kollmarsreute (DE); Erich Becker, Bad Krozingen (DE)

(73) Assignee: KNF Neuberger GmbH, Freiburg (DE)

( * ) Notice: Subject to any disclaimer, the term of this patent is extended or adjusted under 35 U.S.C. 154(b) by 120 days.

(21) Appl. No.: 10/069,473

(22) PCT Filed: Jul. 14, 2000

(86) PCT No.: PCT/EP00/06727

§ 371 (c)(1),
(2), (4) Date: Jul. 8, 2002

(87) PCT Pub. No.: WO01/14744

PCT Pub. Date: Mar. 1, 2001

(30) Foreign Application Priority Data

Aug. 26, 1999 (DE) ..... 199 40 498

(51) Int. Cl.[7] ..... F15B 2/04
(52) U.S. Cl. ..... 92/80; 92/48; 92/96; 417/244
(58) Field of Search ..... 92/80, 82, 94, 92/96, 48, 97, 99, 100; 417/244, 413.1

(56) References Cited

U.S. PATENT DOCUMENTS

| | | | | | |
|---|---|---|---|---|---|
| 2,414,806 A | * | 1/1947 | Finney | 92/82 |
| 3,027,848 A | * | 4/1962 | Merkle | 92/94 |
| 3,387,566 A | * | 6/1968 | Temple | 92/96 |
| 3,692,437 A | * | 9/1972 | Ray | 92/48 |
| 4,049,366 A | | 9/1977 | Becker | |
| 4,086,036 A | * | 4/1978 | Hagen et al. | 92/99 |
| 4,286,932 A | * | 9/1981 | Nagano et al. | 92/100 |
| 5,387,090 A | | 2/1995 | Becker | |
| 5,554,014 A | | 9/1996 | Becker | |

FOREIGN PATENT DOCUMENTS

| | | |
|---|---|---|
| DE | 337271 | 5/1921 |
| DE | OS2212322 | 9/1973 |
| DE | 4026670 A1 | 3/1992 |
| DE | 4320963 A1 | 10/1994 |
| DE | 4328559 A1 | 3/1995 |
| FR | 1292254 | 3/1961 |
| FR | 2273961 | 1/1976 |
| GB | 1214809 | 12/1970 |
| GB | 1418993 | 12/1975 |

* cited by examiner

*Primary Examiner*—Edward K. Look
*Assistant Examiner*—Igor Kershteyn
(74) *Attorney, Agent, or Firm*—Volpe and Koenig, P.C.

(57) ABSTRACT

A membrane pump (104) with an operating membrane (1) delimiting a conveying space (2), and a supplemental membrane (3) arranged on the side of the operating membrane (1) facing away from the conveying space (2), with a membrane interspace (4) provided between the operating membrane (1) and the supplemental membrane (3) as well as with a pump drive for oscillating movement of the operating and the supplemental membranes (1, 3) in the same direction. The membrane interspace (3) is joined with at least one suction channel (7) for relieving pressure of the membrane interspace (4). The membrane interspace (4) is pneumatically joined through the at least one suction channel (7) with the suction side of this membrane pump (104). The membrane pump of the invention (104) has a high suction capacity without the problem of buckling of the elastic operating membrane (1) in the intake phase.

11 Claims, 5 Drawing Sheets

MEMBRANE PUMP

BACKGROUND

The invention concerns a membrane pump with an operating membrane delimiting a conveying space with a supplemental membrane arranged on the side of the operating membrane facing away from the conveying space, with a membrane interspace provided between the operating membrane and the supplemental membrane as well as with a pump drive for oscillating movement of the operating and supplemental membranes in the same direction, whereby the membrane interspace is associated with at least one suction channel for relieving the pressure of the membrane interspace.

In configuring the membrane of a membrane pump, one endeavors to reach an optimum between rigidity and elasticity. While a high elasticity of the membrane is necessary to keep membrane tensions as low as possible, in contrast, at the same time a high rigidity is to be sought so that the membrane does not buckle under the differential pressure load between the membrane upper side and underside, and thus diminishes the drawing space volume and in the opposite case enlarges the dead space volume.

The diminution of the drawing space volume in connection with membrane vacuum pumps takes place especially in the deeper vacuum region. In this area, great pressure differences between membrane lower and upper side arise. While on the membrane lower side, as a rule atmospheric pressure acts upon the membrane underside, the respective evacuation pressure acts on the upper side of the membrane, whereby the maximal pressure differential results from atmospheric pressure minus the ultimate pressure on the membrane.

With the usual membranes of traditional membrane pumps, especially if these membrane pumps operate in the range of the ultimate pressure and large pressure differentials act upon the membranes, it can be stated that the lateral elastic zone of the flexible membrane is buckled by the atmospheric pressure in the direction toward the conveying space. This "buckling" of the membrane leads to the drawing space volume being decisively diminished, which has negative effects on the suction capacity of the membrane pump.

This change in shape is especially marked with two and multiple stage membrane pumps with low ultimate pressures. With these pumps, the lower vacuum stage is most strongly affected since here the greatest pressure differentials arise.

In order to attain an optimum between the desired elasticity and the necessary rigidity of the membrane, in the past, one again and again found more or less good compromise solutions, whereby frequently a good suction capacity could be reached only by allowing for higher membrane tensions.

From DE 40 26 670 A1, a membrane pump is already known, the intake side of which is connected through a connecting line with the crank space of this membrane pump. In order to be able at least to diminish or even to eliminate the pressure differentials on both sides of the operating membrane and not to expose the operating membrane to additional differential pressure-conditioned stresses, the crank space of this previously known membrane pump stands in connection with its suction side.

The membrane pump previously known from DE 40 26 670 A1 has, however, not been able to succeed in practice because the transmission of the drive forces to the crankshaft situated in the crank space and the connection of this crank space with the suction side of the pump presupposes an additional shaft sealing. Such a shaft sealing is nonetheless associated with further friction losses, higher wear and tear and additional performance requirements. A vacuum in the crank space can in addition lead to an outgassing of the bearing grease in the connecting rod bearing, so that the ball bearing possibly runs dry. Since the bearing lubricant in the crank space can extend into the conveying flow through the connecting line, there exists the danger that the conveying medium will become contaminated.

A multiple stage pump apparatus with a turbo molecular pump is already known from DE 43 20 963 C2 which is connected in series after a two stage rotary pump constructed as a hybrid pump in the path of flow. This hybrid pump has a reciprocating piston pump on the medium entry side after which a membrane pump is connected in series for discharging the conveying medium. The cylinder space of the pistons is closed off from the crank space by means of a sealing membrane. Thereby the interspace provided between the piston on the one hand and the sealing membrane on the other are connected with a drain which opens in the conveying flow direction in front of a suction valve of the cylinder pump.

Since this previously known reciprocating piston pump has a piston, the problems arising with an elastic membrane in connection with pressure differential stresses do not appear with this previously known pump. Rather, with this previously known reciprocating piston pump, the interspace between the piston or its associated gasket on the one hand and the sealing membrane on the other (namely when starting this previously known pump apparatus) can be immediately evacuated to the extent that an unwished overflow from the cylinder space of the reciprocating piston pump into the interspace is absent or is largely avoided, and the entire pump apparatus is therefore ready for operation more rapidly during start up.

From DE 43 28 559 C2, a membrane pump of the type mentioned at the beginning is already known which has an operating membrane, a supplemental membrane as well as a membrane interspace provided between the operating membrane and the supplemental membrane. A drain channel opens into this membrane interspace with the aid of which it is possible to bring the membrane interspace to a lower pressure before the drain channel is closed again.

From FR-A-1 292 254, a membrane-compressor is known, that has a working membrane and a supplemental membrane, which define a membrane interspace there between. The known membrane-compressor includes a pressurized inlet channel that is connected to the membrane-interspace. With the help of the inlet channel, a pressure is created in the membrane interspace that supports the working membrane and which lies between atmospheric pressure and the discharge pressure. In order to control the membrane interspace desired pressure and to be able to reduce the standing pressure on the pressurized side of the compressor, a nozzle is located in the inlet channel. The idea of a pressure discharge is not desired in the compressor known from FR-A-1 292 254.

SUMMARY

There therefore exists the object of creating a membrane pump of the type mentioned at the beginning that is manufacturable with little expense and which is distinguished, even with a high elasticity of the operating membrane, by a high suction volume, and in connection with which undesired impurities of the conveying medium are avoided as far as possible.

The object in accordance with the invention is accomplished with a membrane pump of the type mentioned at the beginning, especially with the characteristics according to the invention.

With the membrane pump of the invention, the membrane interspace is pneumatically joined at least through one drain channel with the suction side of the membrane pump. Consequently, the membrane interspace is continuously evacuated such that, on the upper side of the operating membrane and on the underside of the operating membrane, the same pressures constantly prevail during the suction phase. Since in this phase consequently no pressure differential is operating between the membrane upper side and underside of the operating membrane, the operating membrane cannot buckle in the direction of the conveying space, and an undesired diminution of the drawing space is avoided. Through the larger drawing space volume, the suction capacity in the intake phase is increased. This has an especially positive action in pressure ranges or suction capacity ranges which lie in the vicinity of the end pressure. The pressure differentials only act upon the supplemental membrane where they can have no negative influence upon the suction capacity of the membrane pump.

Since no differential pressure acts upon the operating membrane of the membrane pump of the invention, this operating membrane can be configured highly elastically without having to fear the mentioned "buckling" of this membrane. Through the more elastic layout of the operating membrane, membrane tensions decrease significantly which once again brings a clear increase in membrane life. Moreover, the shear stress arising in connection with the churning work of operating membrane can be reduced, the effectiveness of the pump can be improved, and a delay in discharge caused by buckling of the membrane is avoided.

With the aid of a more elastic operating membrane, the membrane stroke of the membrane pump of the invention can also be increased. Since no atmospheric pressure is acting on the membrane under side of the operating membrane and the operating membrane therefore no longer strikes noisily on the conveying space in the pump head, noise development in connection with the membrane pump of the invention is considerably reduced, which assumes significance especially in such pumps that are to be used as suction pumps in medical technology.

Since with the membrane pump of the invention, only the membrane interspace provided between operating membrane and supplemental membrane, and not the crank space as well, is joined with the suction side of the pump, and since with the membrane pump of the invention the crank space can also continue, for example, to remain under atmospheric pressure, a special shaft sealing in the region of the crankshaft is not necessary. In addition, a penetration of bearing grease into the conveying stream is not to be expected, and undesired contamination of the conveying medium is avoided with certainty.

An especially simple embodiment in accordance with the invention provides that the membrane interspace is pneumatically joined through at least one suction channel parallel to the conveying space with the pump inlet. With this embodiment, the pump on the one hand sucks through the pump inlet and on the other hand, through the suction channel, out of the membrane interspace.

A refinement in accordance with the invention in contrast provides that the pump inlet is pneumatically joined through the membrane interspace and the suction channel with the conveying space. With this embodiment in accordance with the invention, the intake path runs into the pump interior from the pump inlet through the membrane interspace, the at least one suction channel and the inlet valve into the conveying space.

Here a further embodiment in accordance with the invention of independent significance worthy of protection is provided in that, in the membrane interspace, at least one intake filter and/or noise damping element is provided. Such a membrane pump in connection with which the intake filter and/or noise damping element is arranged in the membrane interspace can be configured especially compactly.

In order additionally to counteract an undesired fluttering of the membranes and a development of noise, it is advantageous if the intake filter and/or noise damping element is manufactured of an elastic material and is acted upon by the operating membrane on the one hand as well as on the other by the supplemental membrane.

Here an especially advantageous embodiment in accordance with the invention provides that the intake filter and/or noise damping element basically fills up the membrane interspace.

The intake filter and/or noise damping element provided in the membrane interspace is associated with a particularly low manufacturing expenditure if it is configured as an open-cell foam element arranged between the operating membrane and the supplemental membrane.

In order to counteract a buckling of the elastic operating membrane in the ejection phase if the pressure on the membrane upper side continually rises in the direction of atmospheric pressure, a preferred embodiment in accordance with the invention provides that the operating membrane is allocated an inherently stable membrane bracing which is held on a connecting rod of the pump drive, and the operating membrane is braced form fitted on the membrane reverse side, at least in a central region.

With two stage pumps, the delivery pressure of the first stage lies significantly below atmospheric pressure, that is, in the discharge phase, the pressure on the membrane upper side of the operating membrane only rises slightly. For this reason, it is especially advantageous if the membrane pump of the invention forms the first stage of a multiple stage, especially a two stage pump or pump facility.

According to a further embodiment of the invention of independent significance worthy of protection, it is provided that the operating membrane and the supplemental membrane are joined in one piece with each other into a double membrane. Here it is appropriate if the operating membrane and the supplemental membrane are joined with each other in one piece through a central spacer, and if this spacer has on its side facing away from the conveying space an undercut fastening opening for inserting a form fitted fastening element connected with a connecting rod of the pump drive.

It is especially advantageous if the operating membrane is configured as a shaped membrane with the upper side of the conveying space sided membrane being form-fitted to the contour of the conveying space in the upper dead center of the pump specified by the pump head.

BRIEF DESCRIPTION OF THE DRAWINGS

Additional features of the invention will be understood from the following description of the preferred embodiments in accordance with the invention in connection with the claims and the drawings. The individual features can be utilized singly or in combination in connection with an embodiment in accordance with the invention.

In the drawings

DETAILED DESCRIPTION OF THE PREFERRED EMBODIMENTS

Figure 6:
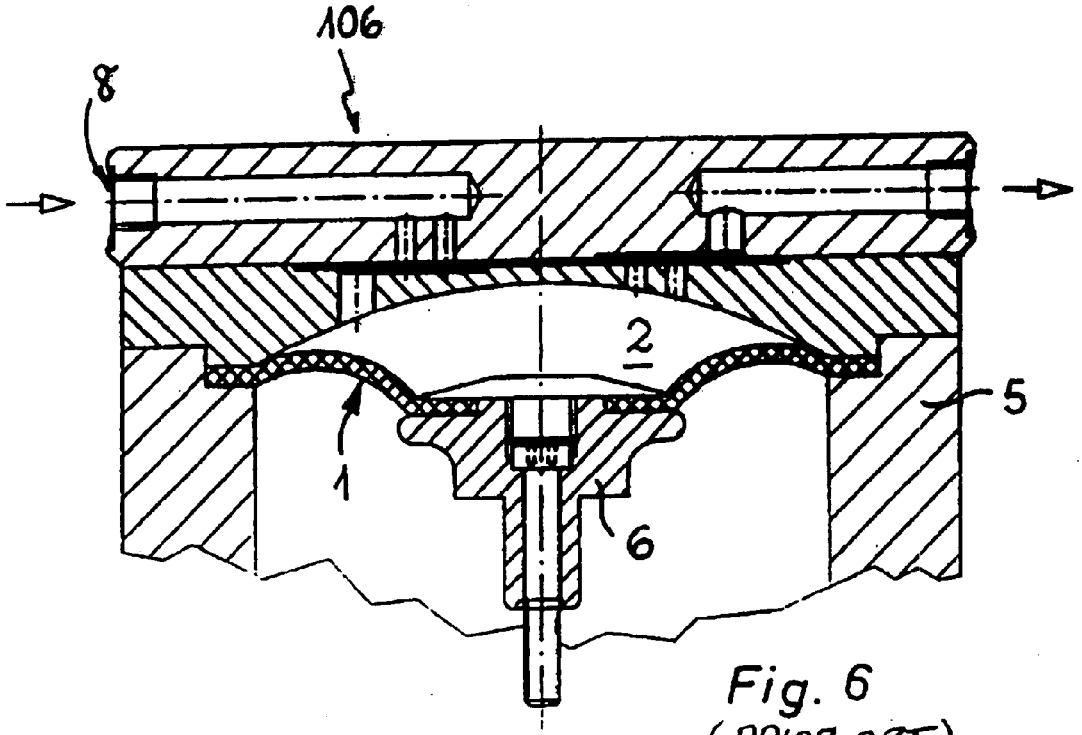
Fig. 6 (PRIOR ART)
FIG. 6 shows a membrane pump belonging to the state of the art with a flat membrane which buckles under the differential pressure stress operating during the intake phase.
Figure 7:
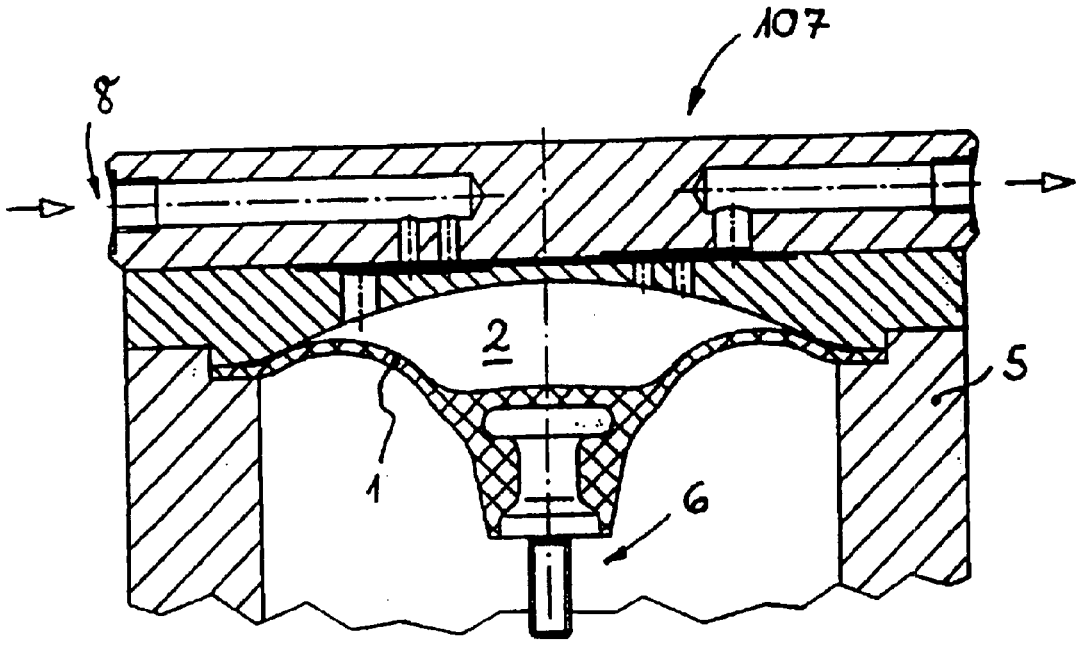
Fig. 7 (PRIOR ART)
FIG. 7 shows a membrane pump likewise belonging to the state of the art in which the molded membrane buckles in the same manner as in FIG. 6.

With the previously known membrane pumps, it is desired to attain an optimum between rigidity and elasticity. A high elasticity of the membrane is necessary so that the membrane tensions are held as low as possible. Especially in the high vacuum range, large pressure differentials between membrane upper side and membrane underside arise. While the respective evacuation process pressure weighs on the membrane upper side, as a rule, atmospheric pressure acts on the membrane underside. As is represented in FIG. 6 and 7, which depict traditional membrane pumps 106, 107 with flat membrane (cf FIG. 6) and with molded membrane (cf FIG. 7), the lateral, especially elastic annular zone of these operating membranes 1 is buckled by atmospheric pressure during the intake phase in the direction of the conveying space 2. Through this "buckling," the drawing space volume is diminished, and the suction capacity of these pumps 106, 107 is reduced.

The membrane pumps 101, 102, 103, 104 and 105 represented in FIGS. 1 to 5 in contrast also have, in addition to a highly elastic operating membrane 1 delimiting a conveying space 2, a supplemental membrane 3, whereby between the operating membrane 1 and the supplemental membrane 3 a membrane interspace 4 is provided. The membranes 1, 3 clamped fast in their outer annular zones in the pump housing 5 engage in their central region on the connecting rod of a pump drive which moves the operating membrane 1 and the supplemental membrane 3 back and forth in the same direction between an upper dead center and a lower dead center. Here only the connecting rod head 6 of the connecting rod of the pump drive is shown.

As is clear from FIGS. 1 to 5, the membrane interspace 4 provided with pumps 101, 102, 103, 104 and 105 is joined through a suction channel 7 with the suction side of these membrane pumps. For this, with the membrane pumps 101, 103 and 105 represented in FIGS. 1, 3 and 5, the membrane interspace 4 is pneumatically connected through the suction channel 7 parallel to the conveying space 2 with the pump inlet 8.

Figure 1:
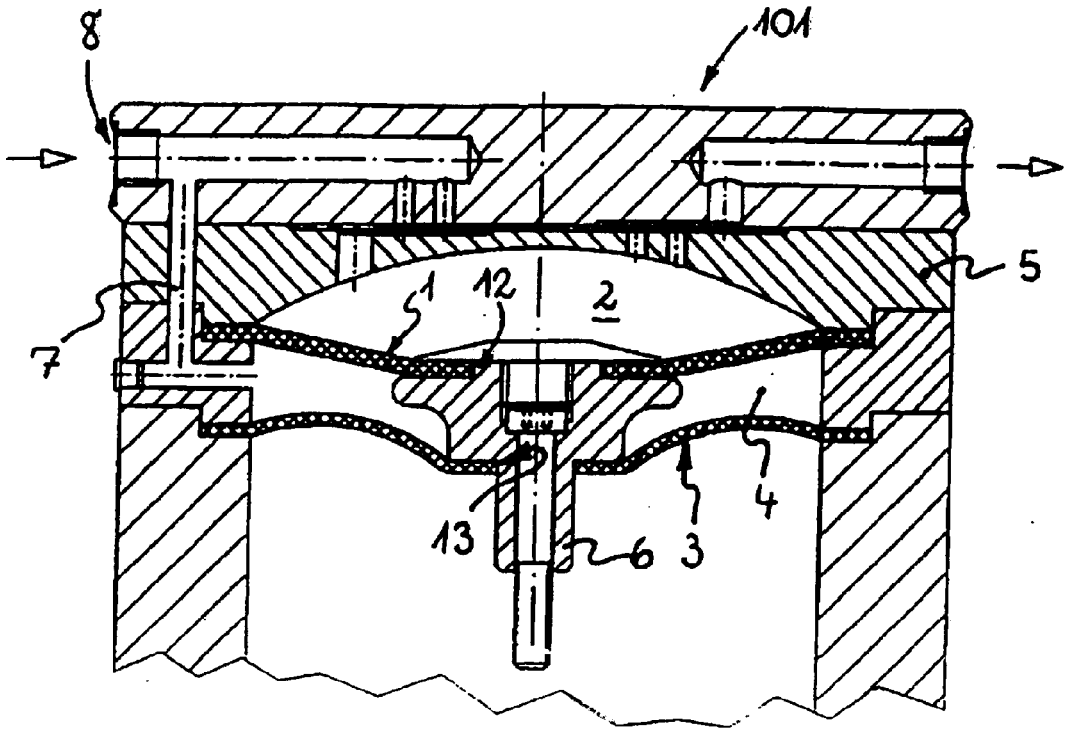
FIG. 1 shows a membrane pump with an operating membrane, a supplemental membrane as well as a membrane interspace provided between these membranes, whereby the membrane interspace is joined through a suction channel parallel to the conveying space with the pump inlet.
Figure 2:
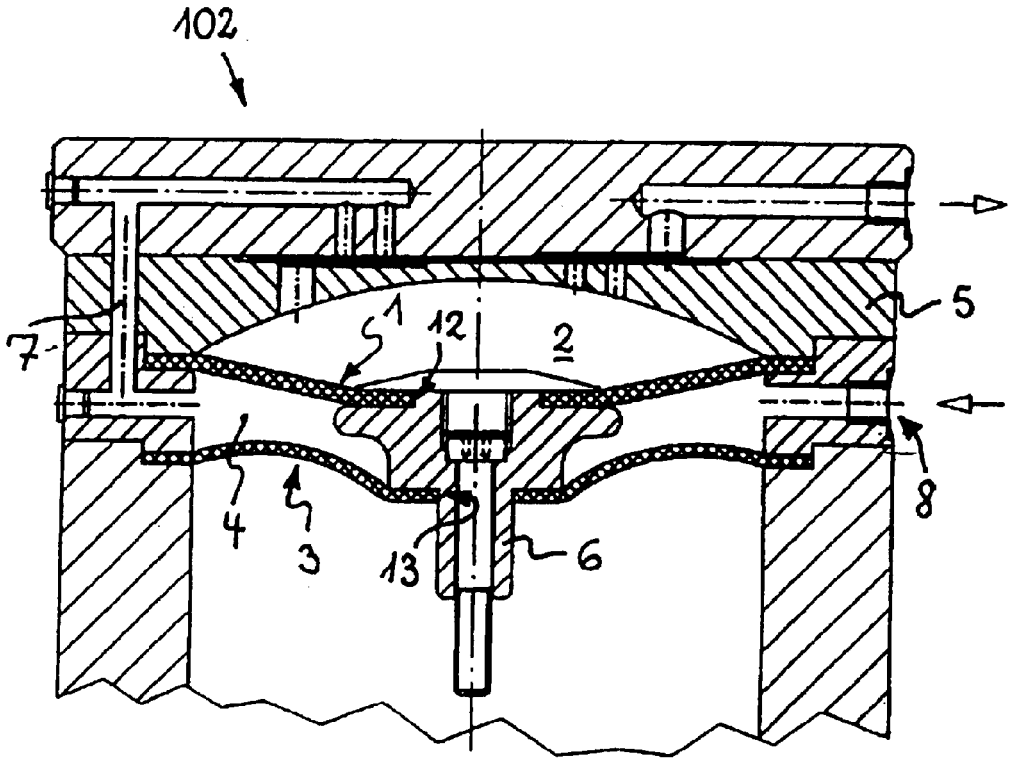
FIG. 2 shows a membrane pump similar to that of FIG. 1, whereby the conveying space is pneumatically joined through a suction channel and the membrane interspace with the pump inlet.
Figure 4:
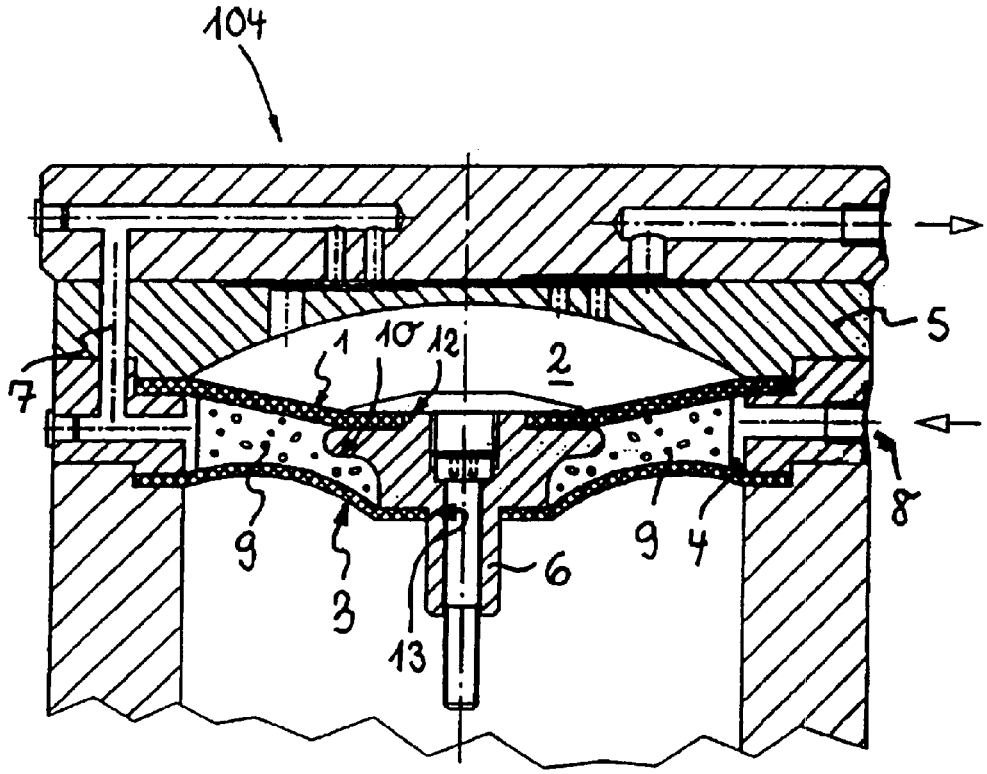
FIG. 4 shows the membrane pump of FIG. 2, whereby an intake filter and noise damping element of open-pore foam is provided which basically fills up the membrane interspace and is acted upon bilaterally by the membranes.

With membrane pumps 102 and 104 in accordance with FIGS. 2 and 4, the pump inlet 8 is in contrast pneumatically joined through the membrane interspace 4 and the suction channel 7 with conveying space 2.

Since with the membrane pumps 101, 102, 103, 104 and 105 represented here, the membrane interspace 4 is pneumatically joined through at least one suction channel 7 with the suction side of the membrane pumps, the membrane interspace 4 is continuously evacuated such that on the upper side of the operating membrane 1 and on the underside of operating membrane 1, the same pressures constantly prevail during the suction phase. Since in the intake phase consequently no pressure differential between membrane upper side and underside of the operating membrane 1 is acting, the operating membrane 1 cannot buckle in the direction of the conveying space and an undesired diminution of the drawing space volume is avoided. Through the larger drawing space volume, the suction capacity in the intake phase can be increased. This is especially significant in pressure ranges or suction capacity ranges which lie in proximity to the ultimate pressure. The pressure differentials act only on the supplemental membrane 3 where they can have no negative influence on the suction capacity of the membrane pump 101, 102, 103, 104 or 105. Since on the operating membrane 1 of membrane pumps 101 to 105, no differential pressure weighs, this operating membrane 1 can be configured highly elastic without having to fear the already mentioned "buckling" of this membrane 1.

In FIG. 4, it is represented that, in the membrane interspace 4 of the membrane pump 104, an intake filter and noise damping element 9 is provided. This intake filter and noise damping element 9 is made of an elastic material, for example of an open cell foam, and is acted upon on the one hand by operating membrane 1 and on the other hand by supplemental membrane 3. The intake filter and noise damping element 9 (which basically fill up the membrane interspace 4) is configured annularly, whereby its annular opening 10 is penetrated by the connecting rod head 6 of the connecting rod joining membranes 1, 3 with each other. Through the intake filter and noise damping element 9 provided in the membrane interspace 4, parts are eliminated and space can be saved, and the membrane pump 104 can be configured especially compactly.

Figure 5:
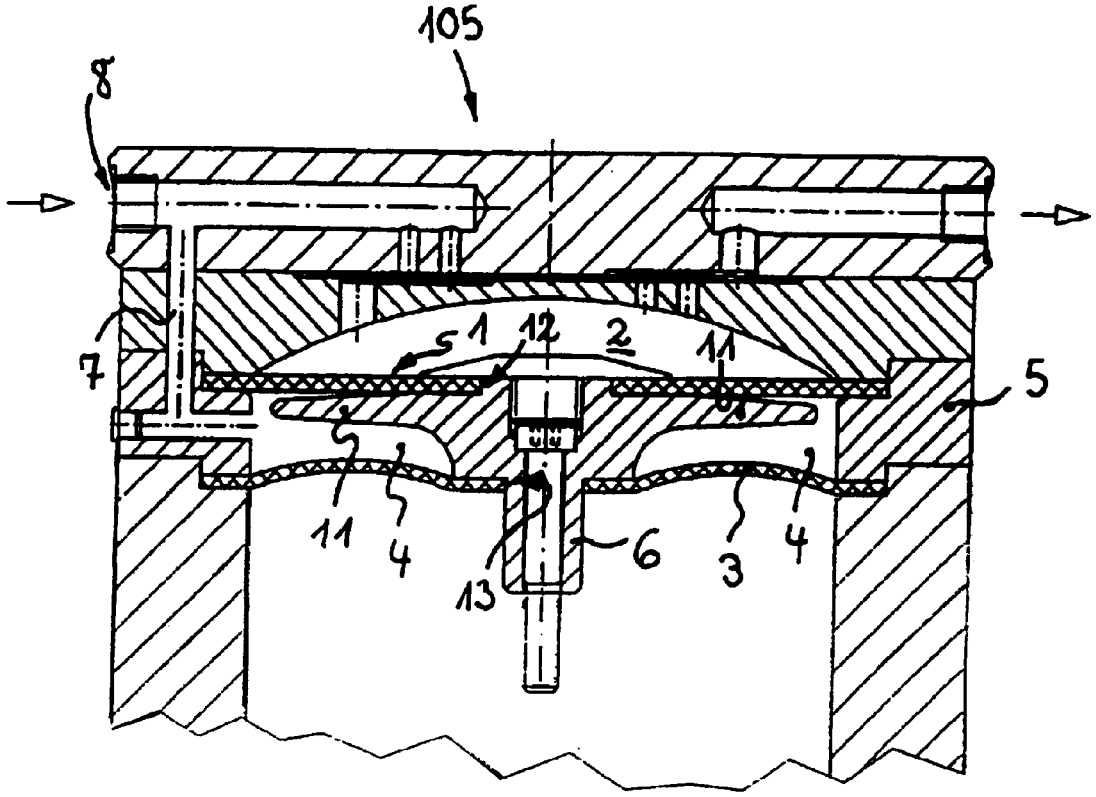
FIG. 5 shows a membrane pump similar to that of FIG. 1, whereby the operating membrane is allocated a inherently stable membrane bracing which supports the operating membrane in the discharge phase.

In FIG. 5, it is represented that the operating membrane 1 of the membrane pump 105 is allocated an inherently stable membrane bracing 11 which is held on the connecting rod head 6 of the connecting rod. While with single stage membrane pumps 101 to 105 in accordance with FIG. 1 to FIG. 5, the membrane interspace 4 is selectively used in the suction phase in order to enlarge the drawing space volume in the discharge phase. When the pressure on the membrane upper side continually rises in the direction of atmospheric pressure, the membrane bracing 11 is inserted which supports in a form-fitted manner the operating membrane 1 of the membrane pump 5 on the membrane reverse side, at least in a central region. In this way, the dead space volume is kept low.

With membrane pumps 101, 102, 104 and 105 in accordance with FIGS. 1, 2, 4 and 5, membranes 1, 3 are clamped fast in the region of a central mounting opening 12, 13 on the connecting rod head 6 of the connecting rod. Not only the supplemental membrane 3, but also the operating membrane 1 of pumps 101, 102, 103, 104 and 105 is configured as a flat membrane.

Figure 3:
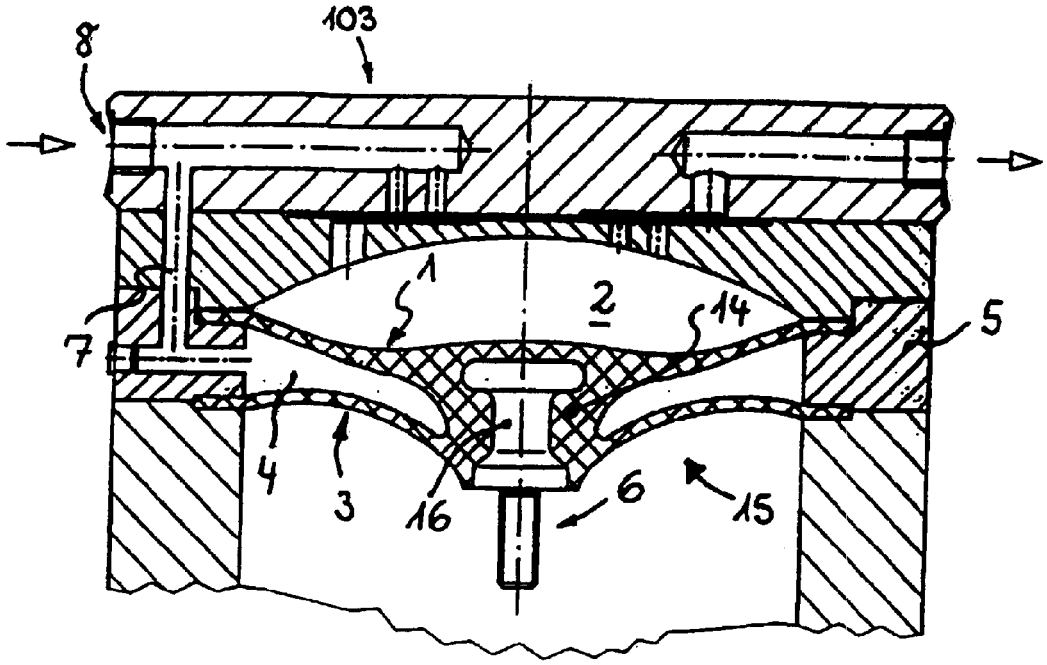
FIG. 3 shows a membrane pump, similar to that of FIG. 1, whereby the operating membrane and the supplemental membrane are joined into a double membrane.

The operating membrane 1 of the membrane pump 103 represented in FIG. 3 is in contrast constructed as a molded membrane. The operating membrane 1 is joined in one piece with the supplemental membrane 3 of membrane pump 103 through a central space 14 into a double membrane 15. As is clear from FIG. 3, the spacer 14 of double membrane 15 has, on its side facing away from the conveying space 2, an undercut fastening opening into which a form-fitted fastening element 16 joined with the connecting rod of the pump drive is inserted. Despite the high elasticity of its operating membrane 1, the membrane pumps 101, 102, 103, 104 and 105 are distinguished by a high suction capacity without a buckling of these comparatively highly elastic operating membrane 1 in the intake phase having to be feared.

Figure 8:
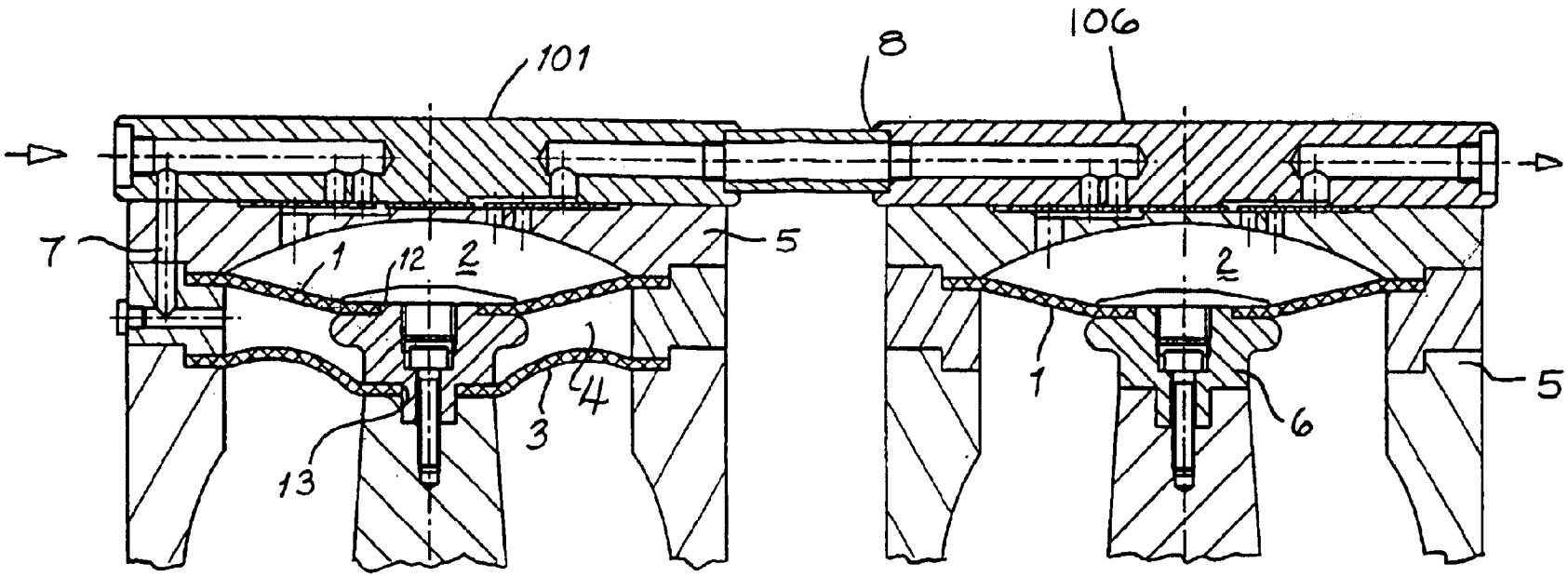
FIG. 8 shows a two-stage membrane pump arrangement in accordance with the present invention.

FIG. 8 shows a two stage pump arrangement in accordance with the invention, in which the pump 101 as described above forms the first stage, and a know prior art membrane pump, such as the pump 106 as described above, forms the second stage. An apropriate connection is provided between the outlet of the first stage pump 101 and inlet 8 of the second stage pump 106.

What is claimed is:

1. Membrane vacuum pump (101, 102, 103, 104 and 105) with an operating membrane (1) delimiting a conveying space (2), and a supplemental membrane (3) arranged on a side of the operating membrane (1) facing away from the conveying space (2), a membrane interspace (4) provided between operating membrane (1) and supplemental membrane (3) and a pump drive connected to the operating and the supplemental membranes (1, 3) for oscillating movement in the same direction, whereby the membrane interspace (4) is connected with at least one suction channel (7) of the pump in order to evacuate and assimilate a pressure condition in the membrane interspace on one side and the conveying space (2) on the other side, and whereby the operating membrane (1) is stretched to the top and bottom dead center points of its oscillating movements, and the membrane pump forms a first stage of a multistage gas pump or pumping facility so that an equal vacuum pressure is applied to both sides of the operating membrane (1) during a suction phase.

2. Membrane vacuum pump (101, 103, 105) according to claim 1, wherein the membrane interspace (2) is pneumatically joined through the pump inlet (8).

3. Membrane vacuum pump (102, 104) according to claim 1, wherein the pump inlet (8) is pneumatically connected through the membrane interspace (4) and the suction channel (7) with the conveying space (2).

4. Membrane vacuum pump (105) according to one of claim 1, wherein the operating membrane (1) includes an inherently stable membrane bracing (11) which is held on a connecting rod of the pump drive and which provides form-fitting support at least in a central region of the operating membrane (1) on a membrane reverse side.

5. Membrane vacuum pump according to claim 1, wherein the operating membrane (1) is configured as a molded membrane.

6. Membrane vacuum pump (101) with an operating membrane (1) delimiting a conveying space (2), and a supplemental membrane (3) arranged on a side of the operating membrane (1) facing away from the conveying space (2), a membrane interspace (4) provided between operating membrane (1) and supplemental membrane (3) and a pump drive connected to the operating and the supplemental membranes (1, 3) for oscillating movement in the same direction, whereby the membrane interspace (4) is connected with at least one suction channel (7) in order to evacuate and assimilate a pressure condition in the membrane interspace on one side and the conveying space (2) on the other side, and whereby the operating membrane (1) is stretched to the top and bottom dead center points of its oscillating movements, the pump inlet (8) is pneumatically connected through the membrane interspace (4) and the suction channel (7) with the conveying space (2), and in the membrane interspace (4), at least one intake filter and/or noise damping element (9) is provided.

7. Membrane vacuum pump according to claim 6, wherein the intake filter and/or noise damping element (9) is made of an elastic material and is acted upon on one hand by operating membrane (1) and on the other by the supplemental membrane (3).

8. Membrane vacuum pump according to claim 6, wherein the intake filter and/or noise damping element generally fills the membrane interspace (4).

9. Membrane vacuum pump according to claim 6, wherein the intake filter and/or noise damping element (9) is configured as an open cell foam element arranged between the operating membrane (1) and the supplemental membrane (3).

10. Membrane vacuum pump (103) with an operating membrane (1) delimiting a conveying space (2), and a supplemental membrane (3) arranged on a side of the operating membrane (1) facing away from the conveying space (2), a membrane interspace (4) provided between operating membrane (1) and supplemental membrane (3) and a pump drive connected to the operating and the supplemental membranes (1, 3) for oscillating movement in the same direction, whereby the membrane interspace (4) is connected with at least one suction channel (7) in order to evacuate and assimilate a pressure condition in the membrane interspace on one side and the conveying space (2) on the other side and whereby the operating membrane (1) is stretched to the top and bottom dead center points of its oscillating movements, and the operating membrane (1) and the supplemental membrane (3) are joined with each other in one piece to form a double membrane (15).

11. Membrane vacuum pump (103) according to claim 10, wherein the operating membrane (1) and the supplemental membrane (3) are joined through a central spacer (11) with each other in one piece, and the spacer (11) has on a side facing away from the conveying space (2) an undercut fastening opening for insertion of a form-fitted fastening element (16) connected with a connecting rod of the pump drive.

* * * * *